US009270066B2

(12) United States Patent
Loh et al.

(10) Patent No.: US 9,270,066 B2
(45) Date of Patent: Feb. 23, 2016

(54) PLUG-IN DEVICE HAVING A PLUG WITH BLADES AND A PIVOT WITH A LOCKING CAM AND A BENDING CAM

(71) Applicant: Velvetwire LLC, Santa Cruz, CA (US)

(72) Inventors: Derek J. Loh, San Carlos, CA (US); Eric O. Bodnar, San Francisco, CA (US)

(73) Assignee: Velvetwire LLC, Santa Cruz, CA (US)

( * ) Notice: Subject to any disclaimer, the term of this patent is extended or adjusted under 35 U.S.C. 154(b) by 0 days.

(21) Appl. No.: 14/526,538

(22) Filed: Oct. 29, 2014

(65) Prior Publication Data

US 2015/0118873 A1 Apr. 30, 2015

Related U.S. Application Data

(60) Provisional application No. 61/897,180, filed on Oct. 29, 2013.

(51) Int. Cl.

| | |
|---|---|
| ***H01R 13/60*** | (2006.01) |
| ***H01R 24/66*** | (2011.01) |
| ***H01R 13/42*** | (2006.01) |
| ***H01R 13/44*** | (2006.01) |
| ***H01R 24/68*** | (2011.01) |
| ***H01R 35/04*** | (2006.01) |
| *H01R 12/71* | (2011.01) |
| *H01R 12/72* | (2011.01) |
| *H01R 13/71* | (2006.01) |
| *H01R 31/06* | (2006.01) |

(52) U.S. Cl.

CPC ..... *H01R 24/66* (2013.01); *H01R 13/42* (2013.01); *H01R 13/44* (2013.01); *H01R 24/68* (2013.01); *H01R 35/04* (2013.01); *H01R 12/714* (2013.01); *H01R 12/724* (2013.01); *H01R 12/728* (2013.01); *H01R 13/71* (2013.01); *H01R 31/065* (2013.01)

(58) Field of Classification Search

CPC ..... H01R 13/44; H01R 13/60; H01R 35/04; H01R 13/42

USPC ..... 439/131, 171–175

See application file for complete search history.

(56) References Cited

U.S. PATENT DOCUMENTS

| | | | | |
|---|---|---|---|---|
| 6,275,002 | B1 | 8/2001 | Chen | |
| 6,454,578 | B1 * | 9/2002 | Yao | H01R 35/04 320/111 |
| 6,641,412 | B2 * | 11/2003 | Kitagawa | H01R 35/04 439/131 |
| 6,821,134 | B2 * | 11/2004 | Chen | H01R 35/04 439/11 |
| 7,001,196 | B1 * | 2/2006 | Huang | H01R 35/04 439/131 |

(Continued)

FOREIGN PATENT DOCUMENTS

| | | |
|---|---|---|
| CN | 202601916 U | 12/2012 |
| JP | 403106674 | 11/1991 |

(Continued)

OTHER PUBLICATIONS

European Search Report Dated Feb. 12, 2015.

*Primary Examiner* — Chandrika Prasad

(74) *Attorney, Agent, or Firm* — HIPLegal LLP; Judith A. Szepesi

(57) ABSTRACT

A structure of a plug-in device with a foldable plug for connecting a power supply to a power-receiving device is provided. The plug-in device includes an upper housing, a blade element, and a lower housing.

20 Claims, 7 Drawing Sheets

(56) References Cited

U.S. PATENT DOCUMENTS 7,481,660 B1 * 1/2009 Tsai ..... H01R 31/065 439/131
7,510,409 B2 * 3/2009 Yu ..... H01R 13/6658 439/131
7,628,621 B2 * 12/2009 Tsai ..... H01R 13/502 439/131
7,787,238 B2 * 8/2010 Liao ..... H01R 31/065 174/50
8,022,668 B2 * 9/2011 Wang ..... H02J 7/0042 320/107
8,622,758 B2 * 1/2014 Hsu ..... H01R 31/065 439/131
8,888,513 B2 * 11/2014 Shi ..... H01R 13/44 439/131
2013/0273753 A1 10/2013 Suzuki et al.

FOREIGN PATENT DOCUMENTS

JP 405020276 3/1993
JP 406060073 8/1994
JP 2000150053 A 5/2000
JP 2002110282 A 4/2002

* cited by examiner

EXPLODED VIEW - FULL ASSEMBLY velvetwire
X
X

DETAIL H
SCALE 4.000

DETAIL I
SCALE 4.000

210
220
250
270
260
SEE DETAIL H
BLADES IN CLOSED POSITION
DESIGNATED FORCE ON BENDING TAB

SEE DETAIL I
BLADES IN OPEN POSITION
MINIMAL FORCE ON BENDING TAB

BENDING CAM

LOCKING CAM

TOP HOUSING WITH BENDING TAB
AND PIVOT LOCATING FEATURES

SEE DETAIL C

DETAIL C
SCALE 4.000

SEE DETAIL D

DETAIL D
SCALE 4.000

BOTTOM HOUSING WITH LOCKING TAB 530
530
510
SEE DETAIL A

520
DETAIL A
SCALE 4.000

530
530
SEE DETAIL B

DETAIL B
SCALE 4.000

CLIP
CLIP 620
610
SEE DETAIL G
SECTION CLIP-CLIP

650

DETAIL G
SCALE 10.000
CLIP AND PCB
640

DETAIL E
SCALE 4.000

DETAIL F
SCALE 4.000
630

610
SEE DETAIL E
SEE DETAIL F

CLIP CONTACT - STRAIGHT BLADE VERSION

CLIP CONTACT - BENT BLADE VERSION

PLUG-IN DEVICE HAVING A PLUG WITH BLADES AND A PIVOT WITH A LOCKING CAM AND A BENDING CAM

RELATED APPLICATION

The present application claims priority to U.S. Provisional Application No. 61/897,180, filed Oct. 29, 2013 and incorporates the provisional application in its entirety.

FIELD

The present invention relates to an plug in device, and more particularly to a plug-in device having a foldable plug.

BACKGROUND

A plug-in device, such as an electrical charger, generally includes an insulating housing, a plug and a circuit mounted within the housing. The plug is used to accept power supplied by an external power source and deliver the power to the circuit. The plug of a typical plug-in device has two conducting blades extending from the housing. The actual configuration of the blades depends on the country for which the plug-in device is designed.

One prior art charger with a foldable plug is the charger provided by PALM COMPUTING®. Their charger has a cylindrical housing base, with a circuit board arranged in the housing base. There is a plastic positioner placed on top of the circuit elements. The paired blades are placed on top of the plastic positioner. The paired blades rest on a holder in the plastic positioner. A housing cover, made of the same material as the housing, is then placed over the blades, and the plastic positioner is bonded to the housing cover. The housing cover is then permanently coupled to the housing base. A force is applied to the blades by a bending tab on the plastic positioner, when a user opens or closes the blades, which snaps the blades into the open and closed positions. The blades exert pressure on the plastic holder continuously, whether they are open or closed.

However, this device has a number of drawbacks. First, it has an extra element that needs to be assembled, bonded to the housing cover, in addition to the two housing pieces. This means that manufacturing and assembly tolerances between the separate pieces may cause issues. Second, use introduces significant stress on the bending tab of the plastic positioner, reducing the feel of the opening and closing click. Third, over time the constant force on the bending tab in the open and closed positions will permanently deform the bending tab and further reduce the feel of the opening and closing force.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

Figure 1B:
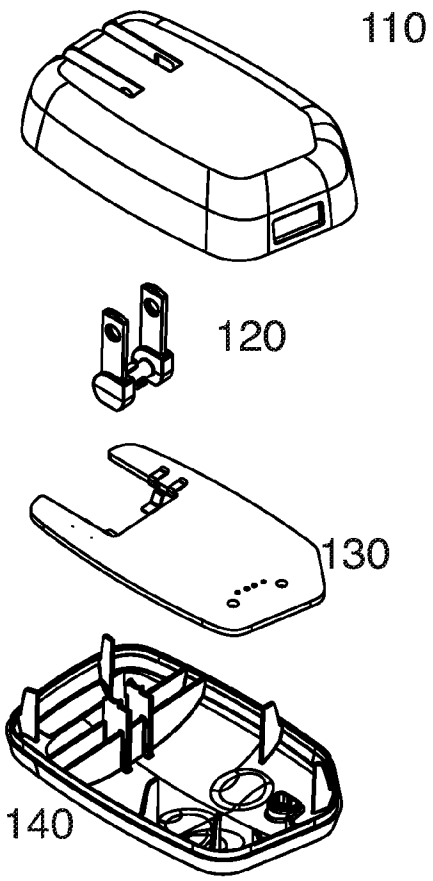
FIG. 1B is an exploded bottom-view illustrating the assembly of a plug-in device having a foldable plug according to one embodiment of the present invention.

The present invention is a plug-in device having a foldable plug, and the configuration of the foldable plug and contacts in the plug-in device. The system in one embodiment includes a housing having a top and a bottom, a circuit board, and a blade element. Rather than three pieces having to fit together to hold the blade assembly, only two elements are needed, the top and bottom housing. No additional elements are needed to hold the plug in place and provide the satisfactory clicking open and closed features. Furthermore, because the plug element is positioned such that when the blade is open no pressure is exerted on the elements of the housing, the foldable plug opening and closing force does not deteriorate with use. In one embodiment, the system utilizes a contact clip to couple a circuit board to the plugs. The contact clip enables solid contact without soldering.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims. Although the example shown is of a charger device, having US-standard plug-in blades, one of skill in the art would understand that any plug-in device with any blade configuration would work in the present invention.

Figure 1A:
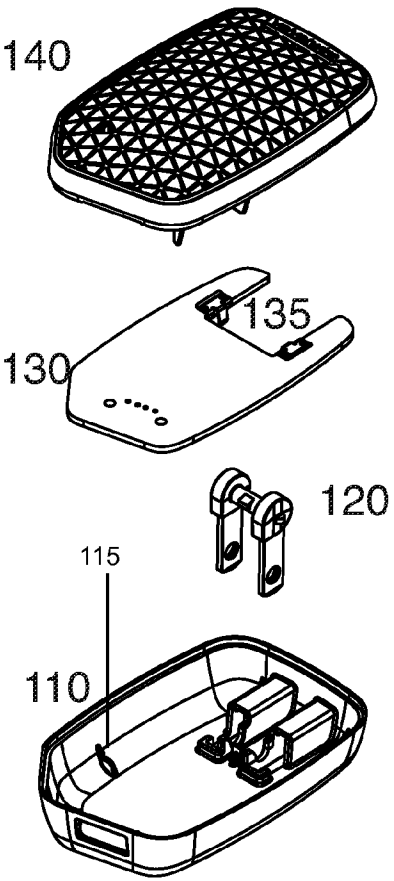
FIG. 1A is an exploded top-view illustrating the assembly of a plug-in device having a foldable plug according to one embodiment of the present invention.

The present invention is illustrated by way of example, and not by way of limitation, in the figures of the accompanying drawings and in which like reference numerals refer to similar elements and in which:

FIG. 1A is an exploded top-view illustrating the assembly of the plug-in device having a foldable plug according to one embodiment of the present invention. As can be seen, the plug-in device includes a bottom 110, which includes locking tab and a blade holder, where the plug assembly 120 fits. The bottom 110 is an integral element, in one embodiment. A circuit board 130 fits into the bottom 110. In one embodiment, the circuit board 130 is supported on small support steps 115 in the side of the bottom 110. The circuit board 130 has a cut-out 135 in one embodiment, around the blade assembly area. The top 140 fits over the bottom, and provides the pivot positioner and the bending tab, which provides force for locking the blade into the closed position. In one embodiment, the top 140 and bottom 110 are permanently coupled together once the plug-in device is assembled. In one embodiment, the top 140 and bottom 110 are plastic, and are coupled together using ultrasonic welding. In one embodiment, the housing is made of Lexan 940 polycarbonate plastic. Using Lexan 940 provides a non-flammable and impact resistant housing FIG. 1B is an exploded bottom-view illustrating the assembly of the plug-in device having a foldable plug according to one embodiment of the present invention. In one embodiment, the top and/or the bottom elements are each made in a single piece, by a process such as injection molding. In another embodiment, the top 140 or bottom 110 may be made by attaching the blade holder, pivot positioner, and/or bending tab to the appropriate housing element 110, 140. In one embodiment, such attachment may be via adhesive, ultrasonic welding, or another mechanism. Note that the blade element is slightly different in configuration between FIGS. 1A and 1B. In FIG. 1A the contacts for the blade element are on the side, whereas in FIG. 1B the contacts for the blade elements are on the top.

Figures 2A, 2B, 2C, 2D, 2E:
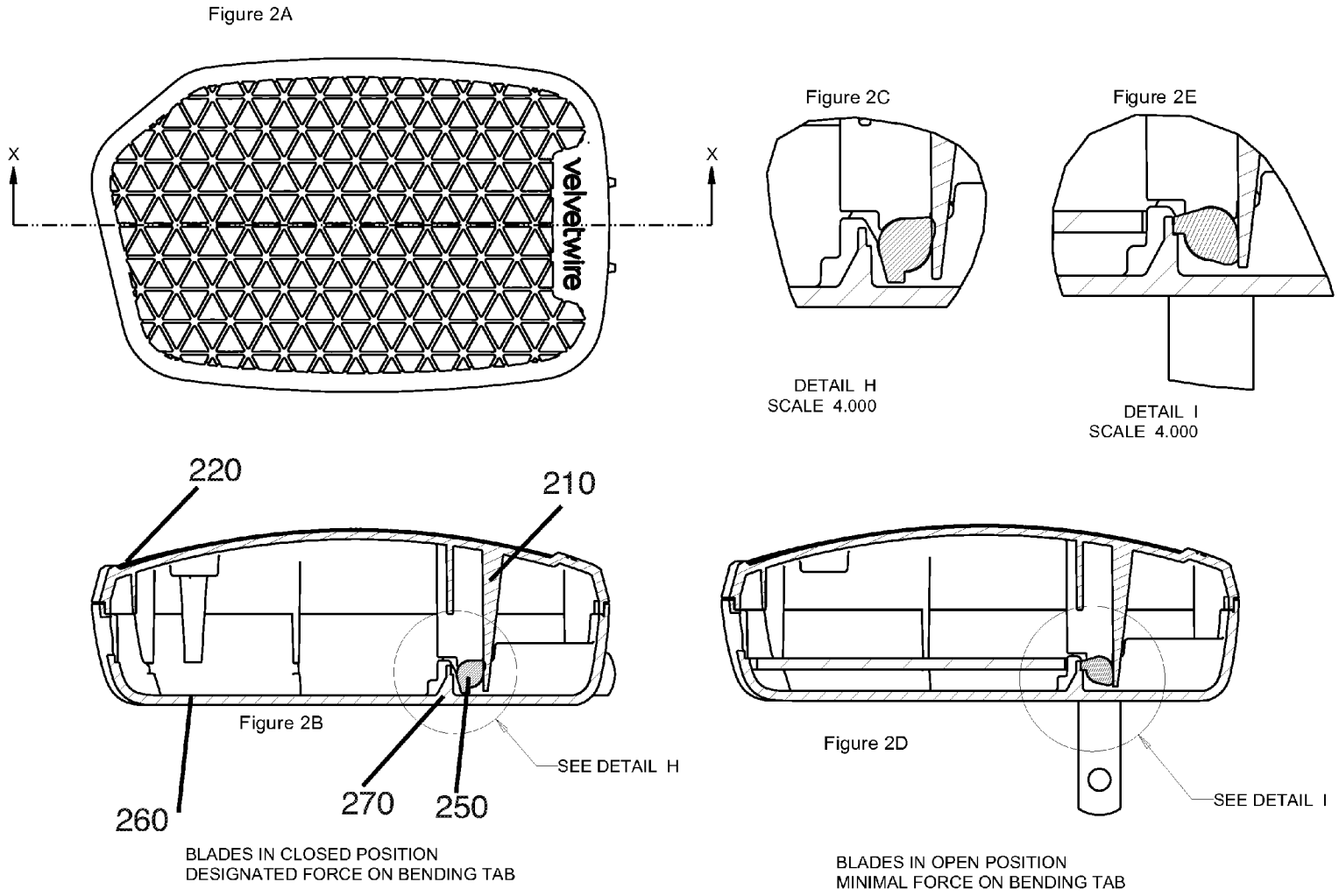
FIGS. 2A-2E are cross-sectional views, showing the foldable plug assembly, in the open and closed configuration according to one embodiment of the present invention.

FIG. 2A-2E are cross-sectional views, showing the foldable plug assembly, in the open and closed configuration according to one embodiment of the present invention. FIG. 2A illustrates the top of the case, showing the cut for the cross-sectional views. As can be seen in FIG. 2B, and in more detail in FIG. 2C, with the blade closed the bending tab 210 coupled to the top of the housing 220 pushes the pivot 250 of the blade assembly against the blade holder 270 in the bottom of the housing 260.

In one embodiment, the pivot 250 is shaped with two cams, referred to as the bending cam and the locking cam. An embodiment of the pivot including the two cams can be seen in FIGS. 3A and 3B in more detail. When the blade is closed, as shown in FIGS. 2B and 2C, the bending cam is positioned against the bending tab, ensuring that the blades remain closed.

When the blades are open, as shown in FIGS. 2D and 2E, the locking cam is on the blade holder, and the bending tab has minimal force or no force exerted on it. The locking cam ensures that the blades remain open.

Figure 3B:
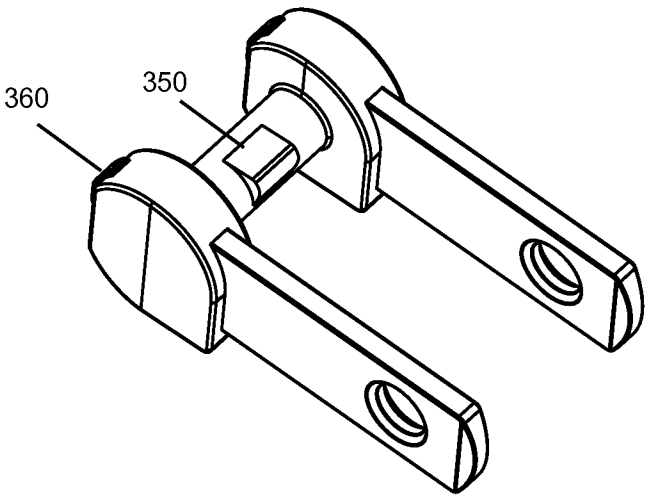
FIGS. 3A-3B are top and bottom views of embodiments of the blade element, including the pivot and the cams.
Figure 3A:
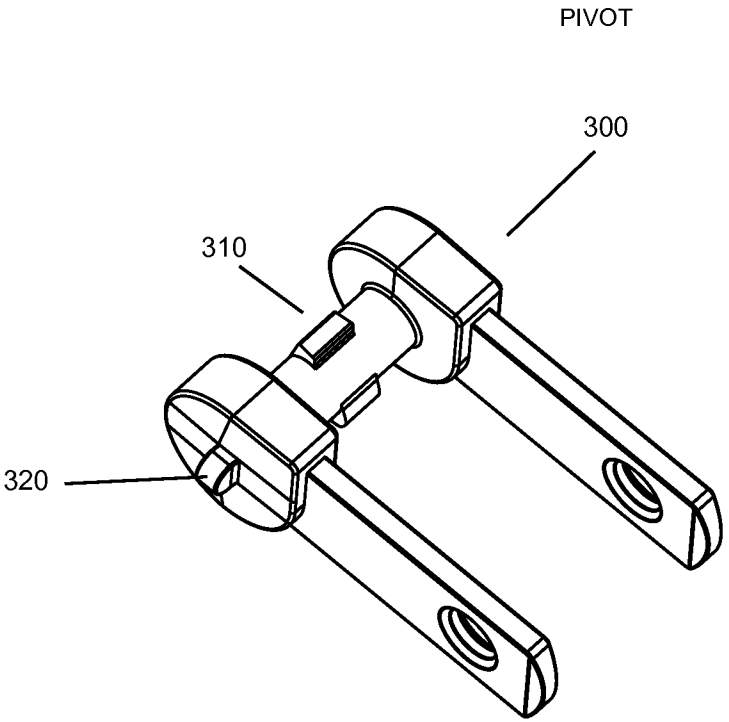
Figures 4A, 4B, 4C, 4D:
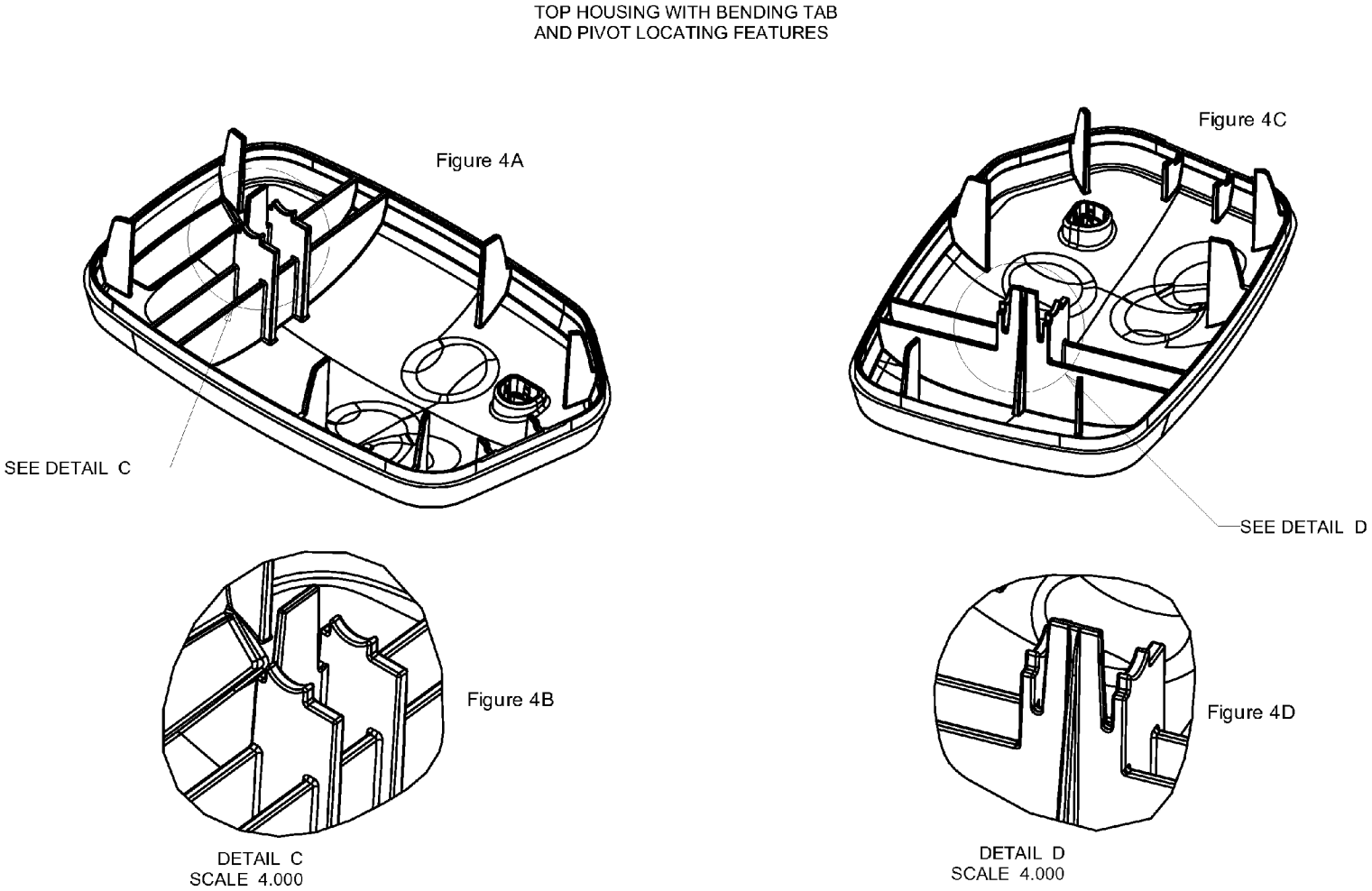
FIGS. 4A-4D are views of the top housing, including the bending tab and pivot positioner according to one embodiment of the present invention.
Figures 5A, 5B, 5C, 5D:
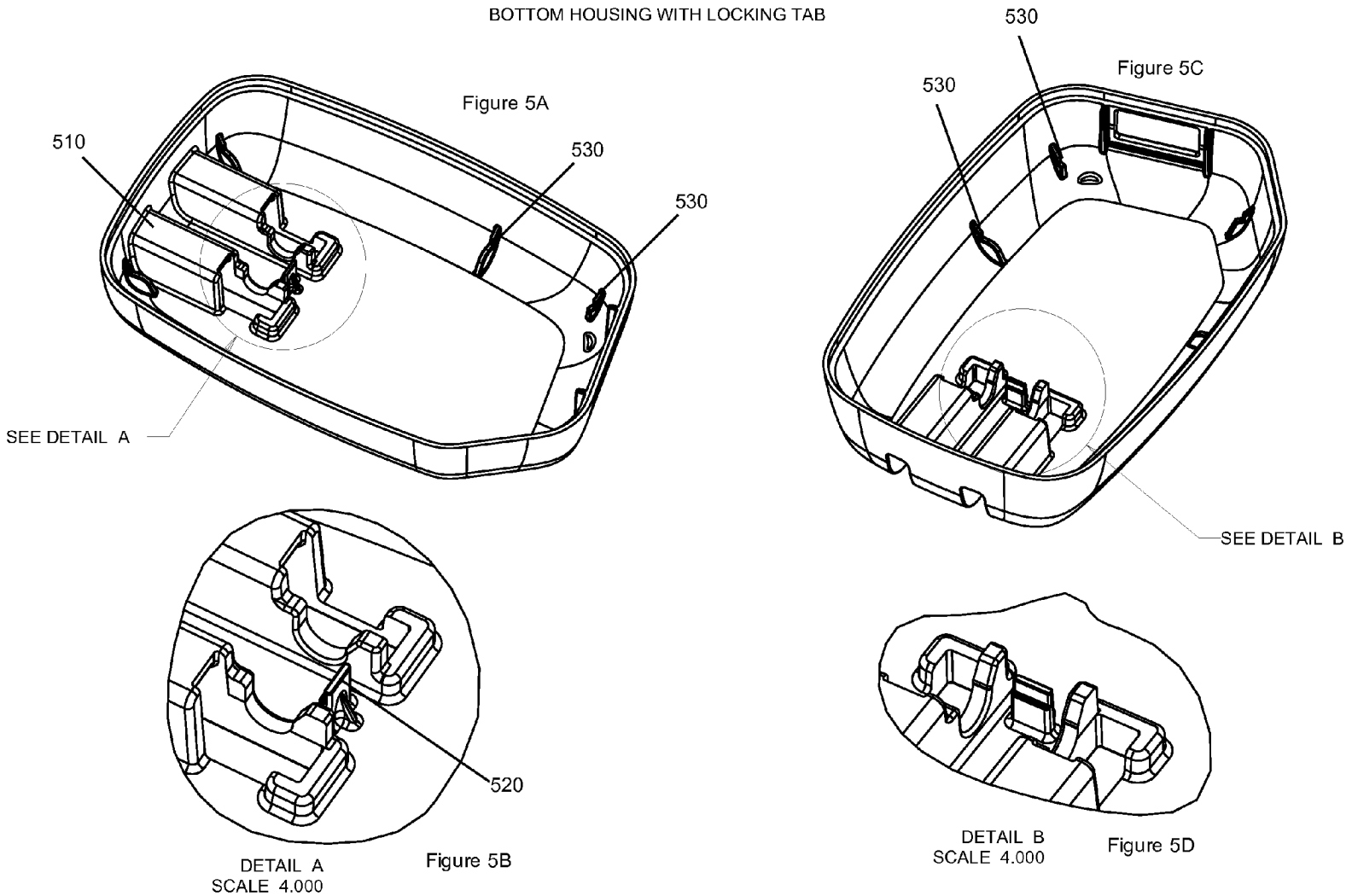
FIGS. 5A-5D are the views of the bottom of the housing, including the plug assembly seat, blade positioner, and locking tab according to one embodiment of the present invention.

FIGS. 3A-3B are top and bottom views of embodiments of the blade element, including the pivot 300 and the cams 310, 350. The central pivot element includes the two cams 310, 350, discussed above. The cams 310, 350 lock the blade elements into the two positions, open and closed. FIG. 3A shows one embodiment of the locking cam 310, which ensure that the blades remain open once opened. FIG. 3B shows one embodiment of the bending cam 350, which ensure that the blades remain closed, and open with a satisfying click, when closed. Additionally, the cam 310 of FIG. 3A shows an electrical contact 320 at the sides of the blade element. FIG. 3B in contrast, shows the electrical contact 360 at the bottom of the blade element. Other locations for the electrical contact may also be used.

FIGS. 4A-4D are views of the top housing, including the bending tab and pivot positioner according to one embodiment of the present invention. As can be seen, in one embodiment the top housing has a positioner consisting of rounded plastic elements integral with the housing, that ensure that the blade element stays in place and can rotate. It also has a bending tab, which provides force to provide the click-feel of the blade opening and closing. The click-feel is the snapping motion and sound that people expect when opening and closing a foldable plug.

In one embodiment, though not specifically shown, the entire top housing may be injection-molded from a single piece of plastic. In another embodiment, the cross-ribs shown which provide support for the housing and stability for the elements of the blade are attached to the housing. In one embodiment the plastic is Polycarbonate.

FIGS. 5A-5D are the views of the bottom of the housing, including the plug assembly seat, blade positioner 510, and locking tab 520 according to one embodiment of the present invention. As can be seen, the blade positioner 510 includes grooves for the blades to reside in, when the blades are in the closed position, as well as rounded areas in which the pivot is placed. In one embodiment, the locking tab 520 is a small element, on top of which the locking cam rests when the blade is in the open position. This ensures that the blades do not turn too far when they are opened. It also enables the blade assembly not to exert force on the bending tab when the blade is in the open position. The bottom of the housing also includes support steps 530 on which a circuit board rests.

In one embodiment, though not specifically shown, the entire bottom housing may be injection-molded from a single piece of plastic. In another embodiment, some elements may be glued into the housing. In one embodiment the plastic is Polycarbonate. This means, however, that the blade element, which is designed to conduct power from the AC outlet to a circuit board located within the housing, requires an electrical contact.

In one embodiment, the blade element, shown in FIG. 3A has a contact point at the ends of the pivoting element, shown as the small extending piece in the drawing. In another embodiment, shown in FIG. 3B, the blade element has a contact at the top of the blade enclosure. Other configurations may be used. The contact point(s) are designed to couple the metal of the blade to the circuit board (not shown here, but which can be seen in FIGS. 1A and 1B). The contact point is electrically coupled to the circuit board, in one embodiment, via a contact clip element.

FIGS. 6A-6G are views of the circuit board where the contact clip element is attached, including views with the contact clip element according to one embodiment of the present invention.

Figures 6A, 6B, 6C, 6D, 6E, 6F, 6G:
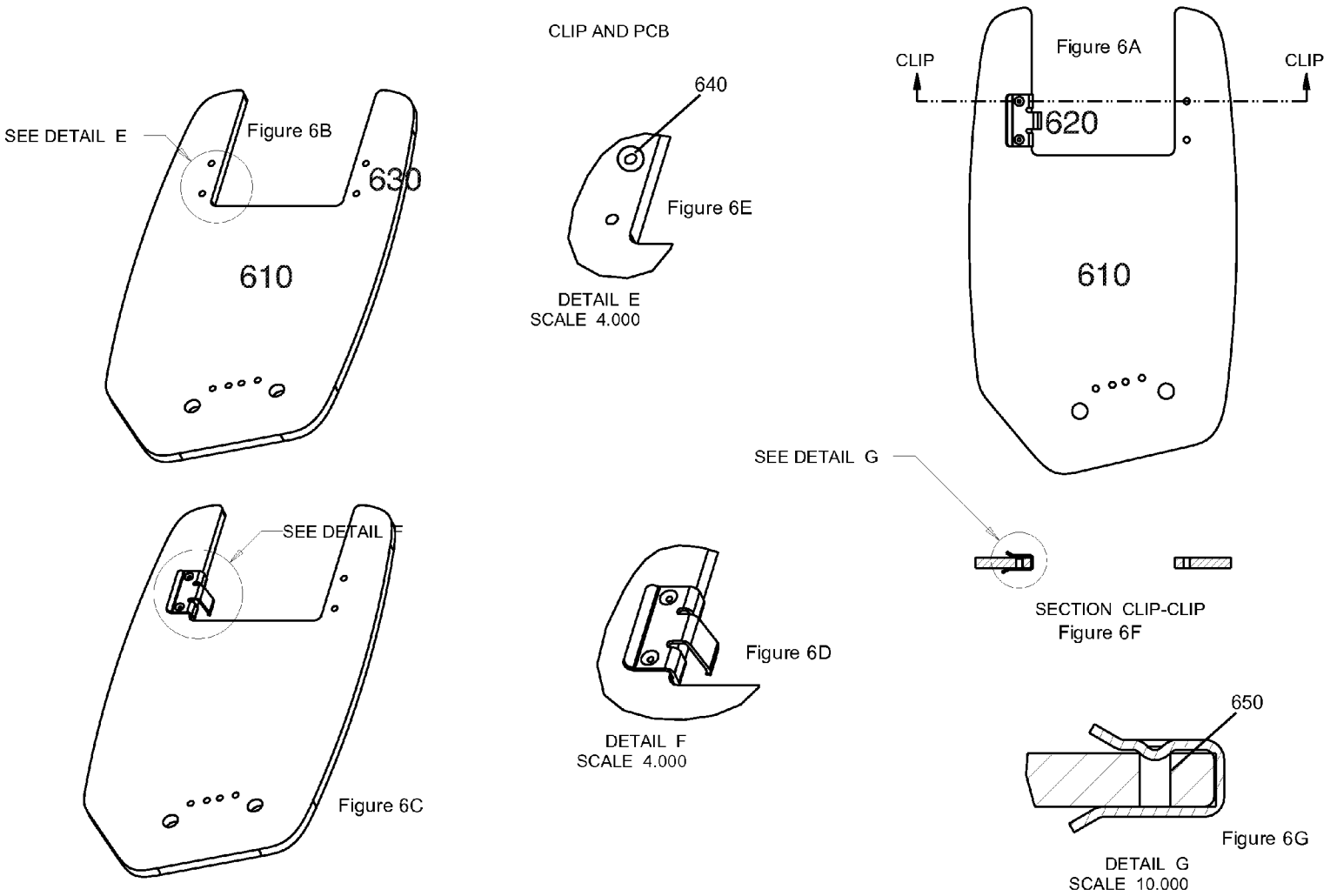
FIGS. 6A-6G are views of the circuit board where a contact clip element is attached, including views with the contact clip element according to one embodiment of the present invention.

FIG. 6A illustrates the circuit board 610 and clip 620 attached to the circuit board. Printed circuit boards, in general, connect components using conductive tracks on a substrate. Various elements may be mounted on a circuit board using through-holes into which the pins of the elements are inserted, or surface pads onto which pins of the elements are attached. In one embodiment, conductors on different layers are connected through electrically conductive holes called via.

When the circuit board 610 is prepared, in one embodiment, alignment holes 630 are placed for each contact clip element 620. In one embodiment, two holes are placed a particular distance apart. The holes 630 are electrically connected through a surrounding surface pad 640, in one embodiment. In one embodiment, the holes themselves are conductive vias 650 that attach to traces or electrical layers on the circuit board. In one embodiment, the alignment holes may be mounting holes that are not conductive. In one embodiment, in that instance surrounding pads 640 in proximity to the mounting holes may be used to electrically connect the contact clip element to the elements on the circuit board.

In the configuration shown, where the circuit board is designed to fit into the plug-in device, the holes 630 for the contact clip elements are placed on either side of the cut-out which surrounds the blade enclosure, and which is in close proximity, therefore, to the blade element, and thus the blade element contacts. The clips are, in one embodiment, shaped to snap into the holes. This enables the placement of the contact clips without any soldering. FIG. 6G shows the cross-section, showing that a dimple in the clip fits into a drilled alignment hole securely. Although the contact clips are removable, they are securely attached. In one embodiment, the clips are gold plated.

Figures 7A, 7B, 7C, 7D, 7E, 7F, 7G, 7H:
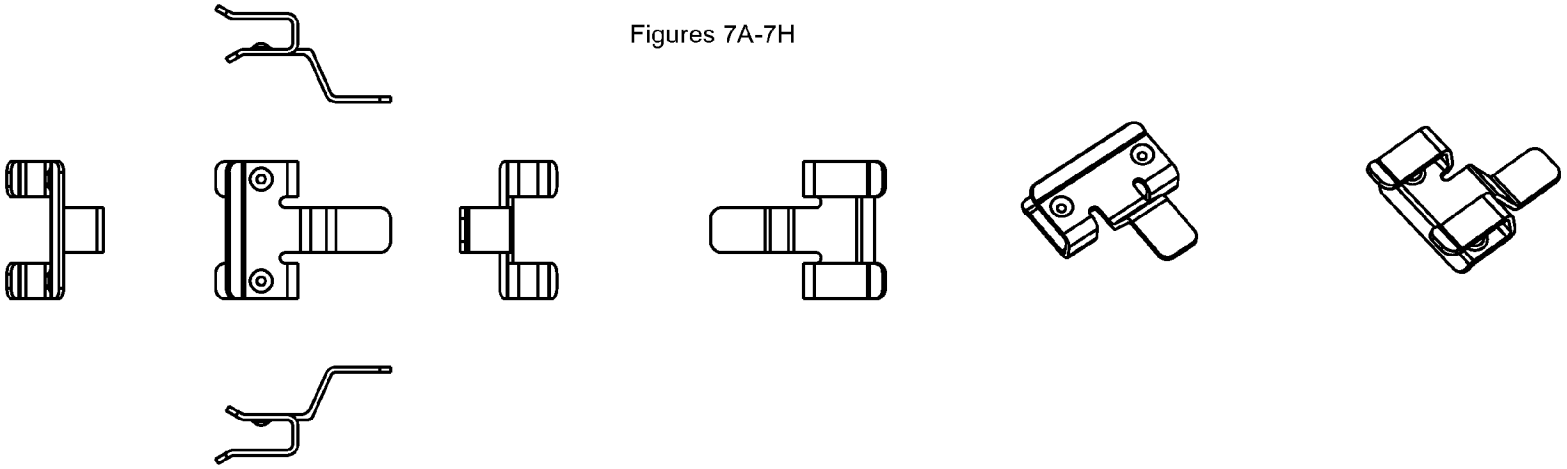
FIGS. 7A-7P are views of embodiments of the contact clip element, designed to clip into a circuit board, to provide an electronic contact without soldering.
Figures 7I, 7J, 7K, 7L, 7M, 7N, 7O, 7P:
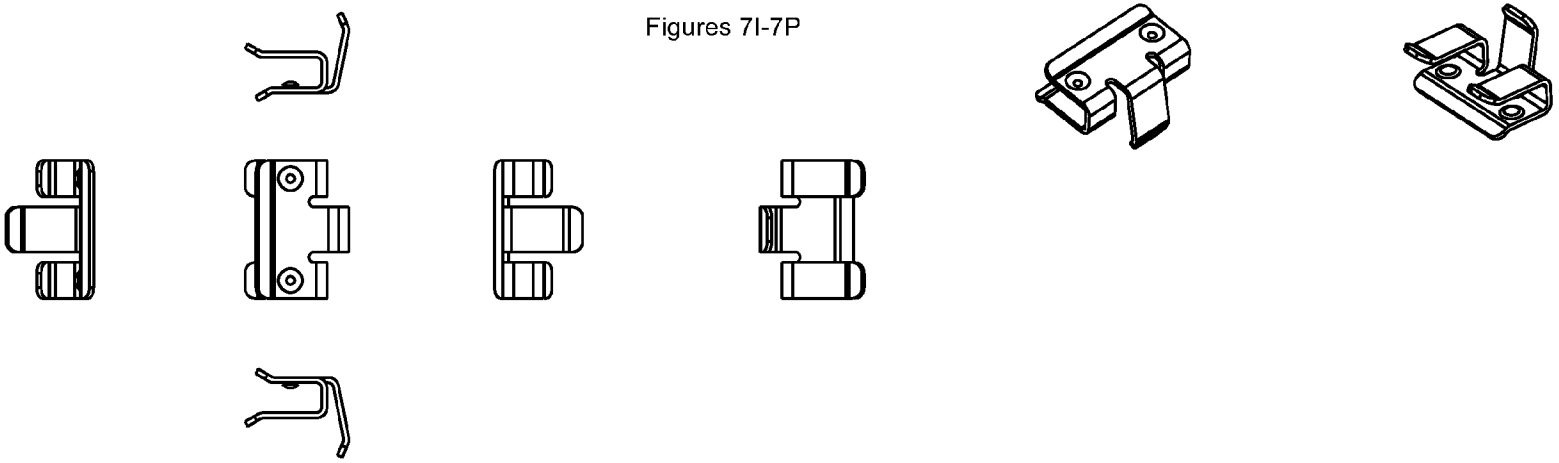

FIGS. 7A-7P are views of two exemplary embodiments of the contact clip, designed to clip onto a circuit board, to provide an electronic contact without soldering according to one embodiment of the present invention.

FIG. 7A-H show one embodiment of the contact clip element, showing the upward extending contact point. This configuration is designed to be coupled to a blade element that has as its contact points at the ends of the pivoting element.

FIG. 7I-P show another embodiment of the contact clip element, showing the sideways extending contact point. This configuration is designed to be coupled to a blade element that has as its contact points at the top of the pivoting element.

Alternative configurations of the clip may be used. It should be understood by one of skill in the art that such snap-on contacts may be used in designs other than a plug in-device or charger. A snap-on contact may be used in any system that requires a contact with an off-circuit-board connection. The shapes of the contact clip elements shown in the figures are merely exemplary. At its core, the contact clip element encompasses any clip-on connection that is designed to be coupled to the edge of a circuit board using a drilled hole on a circuit board, to electrically connect an off-board element with the circuit board.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A plug-in device to connect a power supply to a power-receiving device, comprising:

a plug element including a pivot and blades, the pivot including a locking cam and a bending cam;

a lower housing including a blade holder to position the plug element and a locking tab;

an upper housing including a blade positioner to lock in the plug element, and a bending tab integral with the upper housing;

wherein when the blades are in the open position, there is minimal force on the bending tab, and a length of the bending tab provides force with little pressure on an attachment location of the bending tab on the upper housing.

2. The plug-in device of claim 1, wherein the lower housing including the blade holder is a single integral element.

3. The plug-in device of claim 1, further comprising:

an electrical contact in the plug element, to couple the power from the blades to a circuit board.

4. The plug-in device of claim 3, wherein the electrical contact is located on sides of the pivot of the plug element.

5. The plug-in device of claim 3, wherein the electrical contact is located on a circumference of the pivot of the plug element.

6. The plug-in device of claim 1, further comprising:

the lower housing including small support steps to support a circuit board.

7. The plug-in device of claim 6, further comprising:

a contact clip element to clip into alignment holes drilled into the circuit board, to electrically couple the plug element to the circuit board.

8. The plug-in device of claim 7, wherein the contact clip element is shaped to contact an electrical contact in the plug element.

9. The plug-in device of claim 7, wherein the contact clip is mechanically aligned by the alignment holes in the circuit board.

10. The plug-in device of claim 7, wherein the contact clip is electrically coupled to elements of the circuit board through one of:

plating of the alignment holes in the circuit board, or a surrounding pad on the surface of the circuit board.

11. A plug-in device to connect a power supply to a power-receiving device, comprising:

a plug element including a pivot and blades, the pivot including a cam;

a housing including an upper housing and a lower housing, the upper housing and lower housing comprising a rigid casing for the plug-in device, the housing including positioning elements for the plug element, the upper housing including an integral bending tab which makes contact with the cam in the plug element and the lower housing including an integral blade holder, the blades held in place in an open position or a closed position using a combination of the cam, blade holder, and bending tab;

such that the housing is made of two elements, the upper housing and the lower housing, the two elements providing tabs to lock the plug element in the open and the closed position, without requiring additional elements.

12. The plug-in device of claim 11, further comprising:

a bending tab integrally attached to the upper housing, wherein the plug element is in the lower housing, and a length of the bending tab provides force against the cam of the plug element to maintain the plug element closed, with little pressure on an attachment location of the bending tab on the upper housing.

13. The plug-in device of claim 11, further comprising:

an electrical contact in the plug element, to couple the power from the blades to a circuit board.

14. The plug-in device of claim 13, further comprising:

a contact clip element to clip into alignment holes drilled into the circuit board, to electrically couple the plug element to the circuit board.

15. The plug-in device of claim 14, wherein the electrical contact is located on sides of the pivot of the plug element, and the contact clip element is shaped to touch the electrical contact on the sides of the pivot.

16. The plug-in device of claim 14, wherein the electrical contact is located on a circumference of the pivot of the plug element, and the contact clip element is shaped to touch the electrical contact on the circumference of the pivot.

17. A method of assembling a plug-in device, comprising:

inserting a plug element, including a pivot with a cam and blades, into a lower housing element;

placing a circuit board in the lower housing element, the circuit board including a cut-out for an area around the plug element;

positioning an upper housing on the lower housing element, the upper housing including an integral bending tab, which touches the cam on the plug element to position the plug elements; and permanently coupling the upper housing and the lower housing element.

18. The method of claim 17, wherein the plug element includes an electrical contact to couple the power from the blades to the circuit board.

19. The method of claim 17, further comprising:

placing a contact clip element into pre-drilled alignment holes in the circuit board to electrically couple the plug element to the circuit board.

20. The method of claim 17, wherein the contact clip element is shaped to contact an electrical contact in the plug element.

* * * * *